US010689948B2

(12) United States Patent
Hardesty et al.

(10) Patent No.: US 10,689,948 B2
(45) Date of Patent: Jun. 23, 2020

(54) ELECTRONIC TIME DELAY APPARATUS AND METHOD

(71) Applicant: GEODynamics, Inc., Millsap, TX (US)

(72) Inventors: John T. Hardesty, Weatherford, TX (US); Dennis E. Roessler, Fort Worth, TX (US); Paul Andrew Church, Danestone (GB); Iain Morrison Macleod, Newmachar (GB); Andrew John Elrick, Peterhead (GB); Peter Alan Joiner, Danestone (GB)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 15/996,076

(22) Filed: Jun. 1, 2018

(65) Prior Publication Data

US 2018/0347314 A1 Dec. 6, 2018

Related U.S. Application Data

(60) Provisional application No. 62/513,909, filed on Jun. 1, 2017.

(51) Int. Cl.
*E21B 34/08* (2006.01)
*E21B 43/1185* (2006.01)
(Continued)

(52) U.S. Cl.
CPC ..... *E21B 34/085* (2013.01); *E21B 34/063* (2013.01); *E21B 34/066* (2013.01);
(Continued)

(58) Field of Classification Search
CPC ..... E21B 34/085; E21B 34/066; E21B 34/063
See application file for complete search history.

(56) References Cited

U.S. PATENT DOCUMENTS 4,306,628 A 12/1981 Adams, Jr. et al.
4,699,241 A 10/1987 Kerekes
(Continued)

FOREIGN PATENT DOCUMENTS

WO 2018013131 A1 1/2018

OTHER PUBLICATIONS

International Search Report and Written Opinion of the International Searching Authority (Forms PCT/ISA/220, PCT/ISA/210 and PCT/ISA/237), dated Aug. 31, 2018, for related International Application No. PCT/US2018/035679.

*Primary Examiner* — Kristyn A Hall
(74) *Attorney, Agent, or Firm* — Patent Portfolio Builders PLLC

(57) ABSTRACT

A time delay apparatus for use with a downhole tool in a wellbore casing. In an exemplary embodiment, the apparatus includes an electronic circuit comprising a timer, a fusible link, a split spool device that includes a center pin held in place in a restrained position with a spool and a spring element surrounding the spool. A pressure applied to a trigger device, such as a rupture disk, activates a pressure switch and starts a timer, configured with a preset countdown time, in the electronic circuit. On expiration of the timer, the timer block of the electronic circuit generates a signal to cause breaking of the fusible link and releasing of the spring element such that the center pin of the split spool travels to a functional position and activates the downhole tool.

25 Claims, 7 Drawing Sheets

(51) Int. Cl.

| | |
|---|---|
| ***E21B 34/06*** | (2006.01) |
| ***E21B 43/12*** | (2006.01) |
| ***E21B 47/00*** | (2012.01) |
| ***E21B 34/14*** | (2006.01) |
| *E21B 34/00* | (2006.01) |

(52) U.S. Cl.
CPC ..... *E21B 34/14* (2013.01); *E21B 43/1185* (2013.01); *E21B 43/128* (2013.01); *E21B 47/0007* (2013.01); *E21B 2034/007* (2013.01)

(56) References Cited

U.S. PATENT DOCUMENTS

| | | | | |
|---|---|---|---|---|
| 8,079,296 | B2 * | 12/2011 | Barton | E21B 43/1185 175/4.56 |
| 2005/0241824 | A1 | 11/2005 | Burris, II et al. | |
| 2015/0345231 | A1 | 12/2015 | Thomas | |
| 2016/0130906 | A1 | 5/2016 | Garvey et al. | |
| 2016/0273308 | A1 | 9/2016 | Williamson, Jr. et al. | |

* cited by examiner

ELECTRONIC TIME DELAY APPARATUS AND METHOD

RELATED APPLICATION INFORMATION

This application claims priority from and incorporates by reference U.S. Ser. No. 62/513,909 filed on Jun. 1, 2017.

BACKGROUND

1. Field of the Invention

The present technology generally relates to downhole wellbore tools, and more specifically a low power-usage electronic circuit and associated mechanical elements configured to create a predetermined time delay between a triggering event and the carrying out of a function downhole, for example opening a valve or firing a perforating gun.

2. Description of the Related Art

In oil and gas extraction applications where a downhole operation may be controlled by pressure, there is sometimes a need to have time delays in a series of pressure-triggered events so that the downhole system can be tested at each pressure before the next event could proceed. Prior art systems utilize fluid restriction having a complex system of microscopic passages that meter fluid as a time delay mechanism. For example, inside a tandem in a gun string assembly, there may be a transfer between the detonating cords to detonate the next gun in the daisy-chained gun string. Detonation can be initiated from the wireline used to deploy the gun string assembly either electrically, or by pressure activation, or by electronic means. In tubing conveyed perforating (TCP), as there is no electric conductor, pressure activated percussion initiation is used to detonate. In TCP a tubing pressure is increased to a preset pressure at which a firing head launches a firing pin, which starts the percussion initiator, which in turn initiates the detonation. There is sometimes a need to delay the launching of a firing pin by a predetermined time, for example, so that tests can be conducted, or a hang fire condition may be detected on a previous gun.

In tandem systems there is a single detonating cord passing through the guns. There are no pressure barriers. However, in select fire systems (SFS) there is a pressure isolation switch between each gun. A detonator feeds off each switch. Each gun is selectively fired though its own detonation train. Thus, for example, when the lower-most perforating gun is perforated, pressure enters the gun. When the first gun is activated, the second detonator is armed when the pressure in the first gun switch moves into the next position, thereby actuating a firing pin to enable detonation in the next gun. All guns downstream are isolated from the next gun by the pressure barrier.

It has become a common practice to install a pressure-responsive opening device at the bottom (or "toe") of a casing string within horizontal well bores, and in some vertical bores. These devices make up and run as an integral part of the casing string. After the casing has been cemented and allowed to solidify, the applied surface pressure is combined with the hydrostatic pressure to open a pressure-responsive valve. The combination of hydrostatic and applied pressure is customarily used to overcome a number of shear pins or to overcome a precision rupture disc. Once communication with the well bore [i.e., area outside of the well casing] is achieved, the well can be hydraulically fractured, or the valve can be used as an injection port to pump down additional wire line perforating guns, plugs or other conveyance means such as well tractors. Other known methods of establishing communication with the cemented and cased well include tubing conveyed or coil tubing conveyed perforators. These are all common methods to achieve an injection point but require increased time and money.

SUMMARY

An exemplary embodiment provides a time delay apparatus for use with a downhole tool in a wellbore casing, the exemplary apparatus includes an electronic circuit with a timer having a preset time. The electronic circuit is in operative communication with a trigger configured to activate the timer to commence a countdown of the preset time. A fusible link is in communication with the timer and with an activator of the downhole tool, and is configured to commence degrading upon expiration of the preset time. The activator of the downhole tool is configured to activate upon degradation of the fusible link.

In an exemplary embodiment, the fusible link is configured to burn (degrade) for a predetermined time interval.

In an exemplary embodiment the downhole tool is a spool valve. The spool valve may include a center pin held in place in a restrained position with the spool that has a spring element surrounding the spool. According to an exemplary embodiment, upon expiration of the preset time of the timer, the electrical circuit automatically generates a signal to commence degrading the fusible link. Upon degradation of the fusible link, a spool valve of the downhole tool releases the restraining spring element such that the center pin travels to a "functional position" from a previous "restrained position," and thereby opens the valve In an exemplary embodiment, the trigger to activate the timer is configured for environmental-activation. In a non-limiting example, the environmental-activated trigger is pressure activated. In another exemplary embodiment, the trigger is electrically or electronically triggered, either by wire or remotely.

Another exemplary embodiment provides a time delay apparatus for use with a downhole tool in a wellbore casing that includes an electronic circuit having a timer with a preset time, and a trigger configured to activate the timer. In addition, the apparatus has a downhole tool activator configured to switch from a restrained position to a functional position, when the preset time of the timer has expired, to thereby activate a downhole tool function.

BRIEF DESCRIPTION OF THE DRAWINGS

For ease of understanding of exemplary embodiments, described herein below in more detail, reference may be made to the accompanying schematic, not-to-scale drawings wherein.

DETAILED DESCRIPTION

Figure 1:
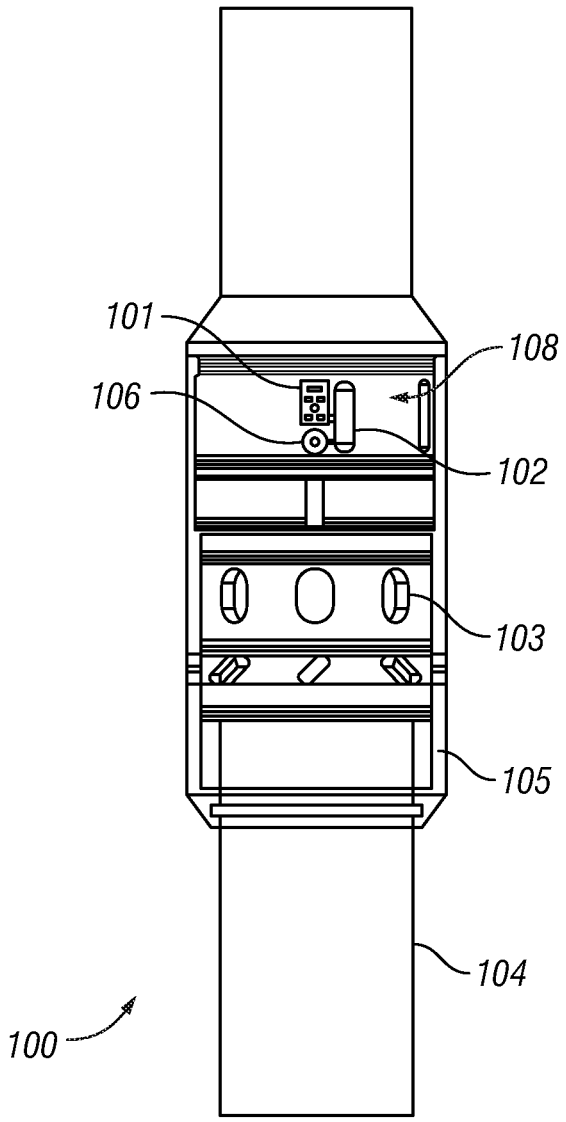
FIG. 1 illustrates an exemplary embodiment of a time delay apparatus installed in a downhole tool, exemplified here by a spool valve.

The present technology provides improved apparatus (and related methods) that provide a time delay in activation of a downhole tool in oil and gas operations. The downhole tool may be any of a variety of tools that are to be activated after some elapse of time. The tools are positioned downhole initially in a "restrained position" to be activated later to a "functional position." The activation takes place after elapse of a time period that is initiated by a triggering event, according to the time delay apparatus of the present technology. Thus, non-limiting examples of downhole tools that may be activated with a time delay, according to the present technology, include but are not limited to: electronic toe valves, sliding sleeve valves, perforating guns, and like downhole tools where a time delay may be useful.

Exemplary embodiments of the time delay apparatus can activate a downhole tool instantly but in a controlled manner. Exemplary embodiments of the time delay apparatus are also capable of activating multiple downhole tools. For example, in circumstances where there are multiple tools that must be opened to a formation, based on variation in actuation pressure of rupture disks. However, if pump pressure cannot reach the all the tools to trigger these, for any reason, then the present time delay apparatus allows the actuation of multiple tools within specified time intervals of each other. In addition, if an initial downhole tool actuation fails, for any reason, the technology provides redundancy so that an activation device of a backup time delay apparatus can activate the downhole tool.

Exemplary embodiments also provide repeatable and reproducible time delays. Examples of embodiments of the present inventions may each provide one or more advantages, such as a predictable time delay, a cost effective time delay solution that is independent of the wellbore conditions, a tubing conveyed perforating gun with a delay mechanism which provides a known delay interval between pressuring the tubing to a second predetermined level and the actual firing of the perforating gun, a mechanism to move a firing pin holder out of locking engagement with a firing pin, to release firing pin, after a predetermined time interval. Exemplary embodiments are low power usage electronic time delay tools, are relatively inexpensive and function reliably at downhole temperatures. In addition, a time delay tool according to exemplary embodiments, is suitable to be wireline conveyed, coil tubing conveyed, casing conveyed or pumped down, with or without a wire.

With regard to downhole tools used in connection with the present time delay apparatus, spool valves allow fluid flow into different paths from one or more sources. These valves usually have a spool, which is mechanically or electrically controlled, inside a cylinder. The movement of the spool restricts or permits the flow through ports, and thereby controls fluid flow. There are two fundamental positions of directional control valve, namely, a "normal position" to which valve returns on removal of an actuating force, and the other is a "working position," which is the position of a valve when the actuating force is applied. Spool valves do not have a control mechanism with a pre-determined delay built-in to switch from a normal position to a working position.

As generally illustrated in FIG. 1, a downhole tool 105, such as a sliding valve, for use in a wellbore casing 104 includes an exemplary time delay apparatus 108. The time delay apparatus may has an electronic circuit 101, a split spool and fuse assembly with a rupture disk 106, and a portable power source, such as a dry cell battery 102. The time delay apparatus 108 may be machined into the mandrel of the downhole tool 105, or mounted in some other convenient way. The downhole tool 105 may be included in the casing string as part of the string and positioned in the wellbore as desired. Or, the downhole tool may be deployed to the desired location with TCP, CT, or a wire line. The wellbore may or may not be cemented.

Figure 2:
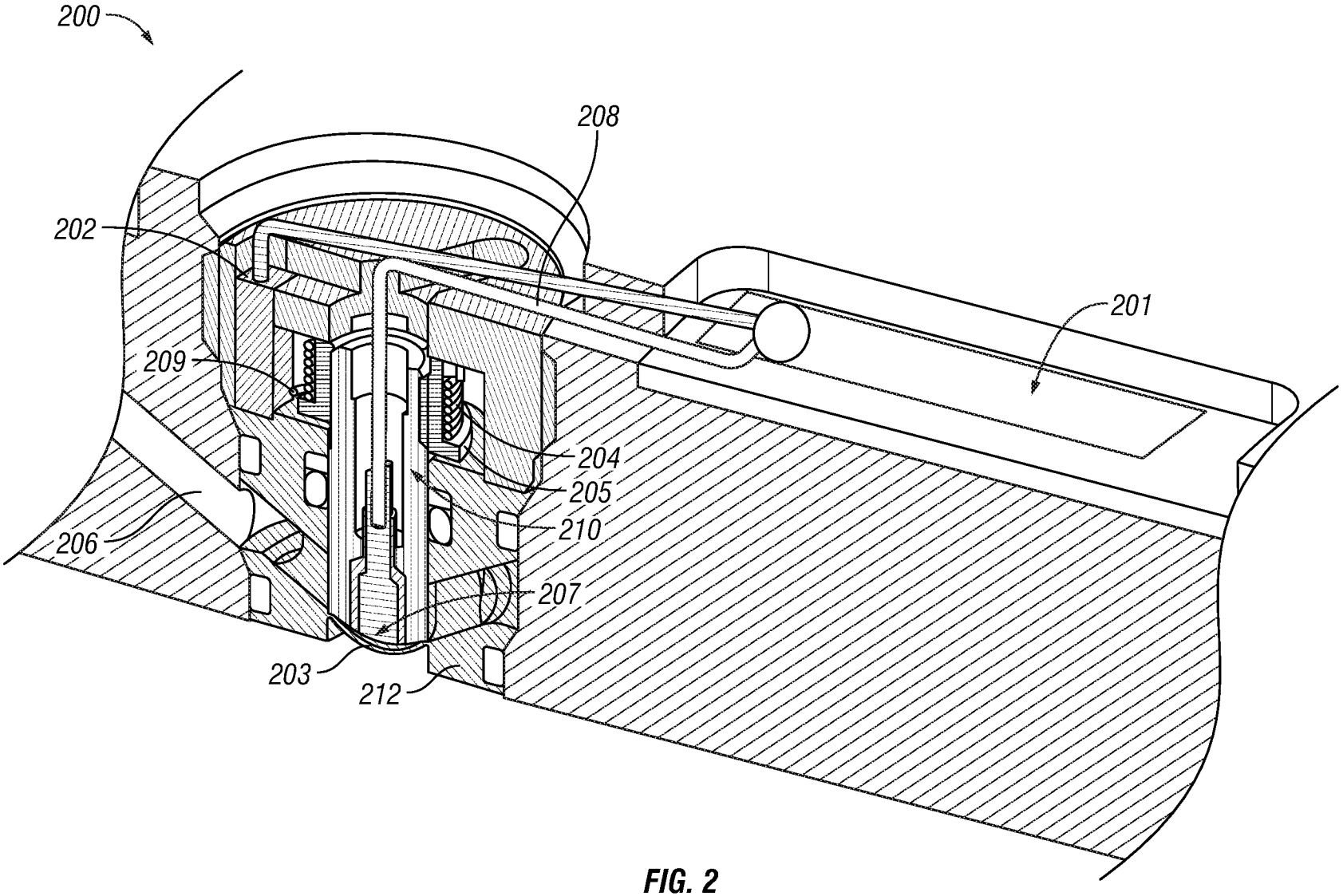
FIG. 2 illustrates a cross-section of an enlarged portion of FIG. 1 an exemplary time delay apparatus with an electronic circuit, fusible link and split spool.

An exemplary downhole tool (a portion 200 of a sliding valve) with a time delay apparatus is illustrated in FIG. 2. The illustration shows components that include an electronic circuit (with a timer) 201, a fusible link 202 electrically connected to the electronic circuit 201, a split spool device 205, and a spring 204 surrounding the spool. (Batteries or a power source to the electronic circuit 201 are not shown in FIG. 2, nor is electrical connection of the fusible link to the electronic circuit.) The split spool device 205 has a center pin assembly 210 held in place in a restrained position by the spool, and the spring 204 surrounding the spool. Pressure applied on a pressure switch (not illustrated here but seen in FIG. 4) or environmental sensor activates the timer in the electronic circuit 201. After elapse of a predetermined time delay, set in the timer by the operator before lowering the tool downhole, the timer block of the electronic circuit generates a signal to initiate burning the fusible link 202. The fusible link, which is mechanically restraining the spring 204, ruptures, thereby breaking the restraining connection 209 between the fusible link 202 and the spring 204. As a result, the center pin 210 travels upwards along with plunger 207 causing the rupture disk membrane 203 of rupture disk 212 to deflect upward and burst thereby opening the port 206 of the sliding valve to permit fluid flow. Of course, in another embodiment, the bursting of the rupture disk can be used to activate an entirely different activity in a downhole tool.

In general, the steps in using the downhole tool equipped with the time delay apparatus are simple. The downhole tool is deployed downhole, with the time delay apparatus mounted to it, and either already pre-configured for a desired time delay, or configured to have a time delay programmed after it is deployed. One deployed and appropriately configured, the time delay apparatus can be pressure activated (or by another activation procedure) by a switch that automatically signals the electronics to start the timer countdown. When countdown is completed, the electronics automatically initiates the fusible link to commence its degrading or burn through. When the fusible link is sufficiently physically weakened, in the case of a wire, it releases the restraining spring of the split spool so that its center pin moves to a functional position from a prior restrained position. The movement of the center pin triggers the bursting of the rupture disk thereby actuating the downhole tool, such as opening a toe valve port, firing a perforating gun, and the like.

An exemplary electrical fusible link may be a type of electrical fuse that is constructed with a short length of wire, typically four American wire gauge sizes smaller than the wire that is being protected. For example, an AWG 16 fusible link might be used to protect AWG 12 wiring. Electrical fusible links are common in high-current automotive applications. The wire in an electrical fusible link may be encased in high-temperature fire-resistant insulation to reduce hazards when the wire melts.

The environmental sensor may be a pressure switch which is a form of switch that closes an electrical contact when a set fluid pressure has been reached on its input. The switch may be designed to make electrical contact either on pressure increase or on pressure reduction.

In general, a pressure switch for sensing fluid pressure contains a capsule, bellows, Bourdon tube, diaphragm or piston element that deforms or displaces proportionally to the applied pressure. The resulting motion is applied, either directly or through amplifying levers, to a set of switch contacts. Since pressure may be changing slowly and contacts should operate quickly, an over-center type of mechanism, such as a miniature snap-action switch may be used to ensure quick operation of the contacts. A non-limiting example of a sensitive pressure switch uses mercury switches mounted on a Bourdon tube wherein the shifting weight of the mercury provides a useful over-center characteristic.

The pressure switch may be adjustable, by moving the contacts or adjusting tension in a counterbalance spring. Industrial pressure switches may have a calibrated scale and pointer to show the set point of the switch. A pressure switch will have a differential range around its set point in which small changes of pressure do not change the state of the contacts. Some types allow adjustment of the differential. The pressure-sensing element of a pressure switch may be arranged to respond to the difference between two pressures. The switches must be designed to respond only to the difference and not to false-operate for changes (fluctuations) in the common mode pressure.

A non-limiting example of a split spool device may be like those used in aerospace and military applications to keep a port closed, a part in place, or a latch closed, etc. Generally, in these types of devices, a center pin may be held in position by a spool that is split in half longitudinally and positioned around the center pin. A spring may be coiled around the pin thereby making the overall diameter larger. The spring may be held in a compressed state by a thread, such as a Kevlar® fiber, so that when a low electric current burns the thread, and the thread breaks due to spring compression energy, the spring is released an expands. Upon spring expansion, it no longer provides support to the split spool. The spool opens and the center pin, no longer supported, is released from a restrained position to a functional position. According to an exemplary embodiment, the split spool device is configured to operatively act on a rupture disk in a downhole tool. The rupture disk is located and configured to burst due to the travel of the released center pin. In another embodiment of a downhole tool that is a toe valve, the split spool device and rupture disk may plug a valve port that opens when the rupture disk bursts thereby allowing fluid to pass through the valve port.

Figure 3A:
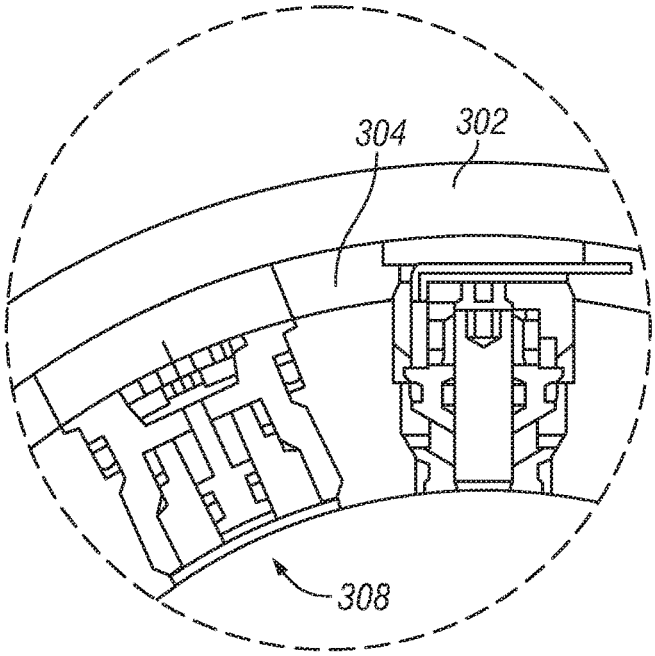
FIG. 3A illustrates a magnified portion of FIG. 3.
Figure 3:
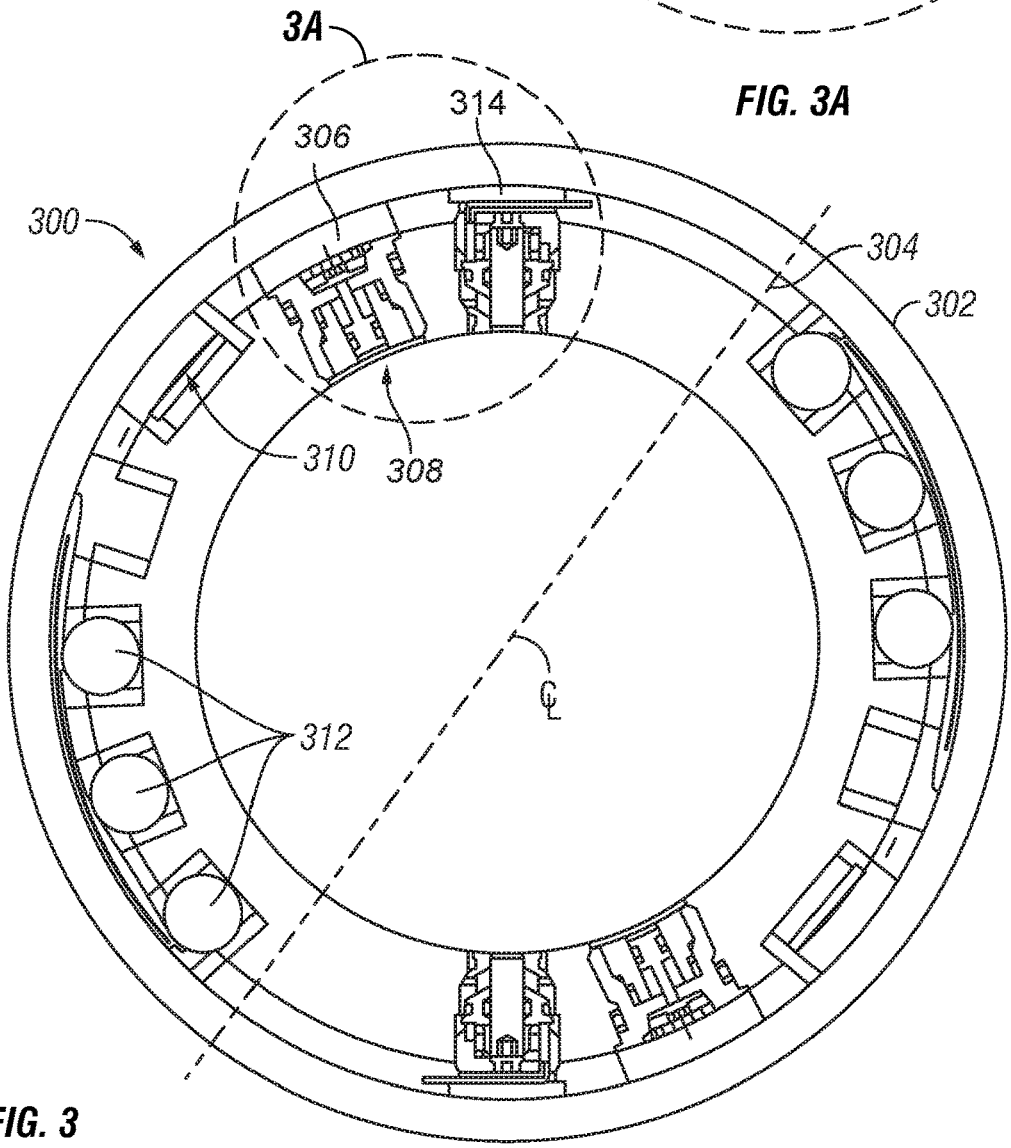
FIG. 3 illustrates in cross section an exemplary embodiment of an electronic toe valve downhole tool with two time delay apparatus.
Figure 3B:
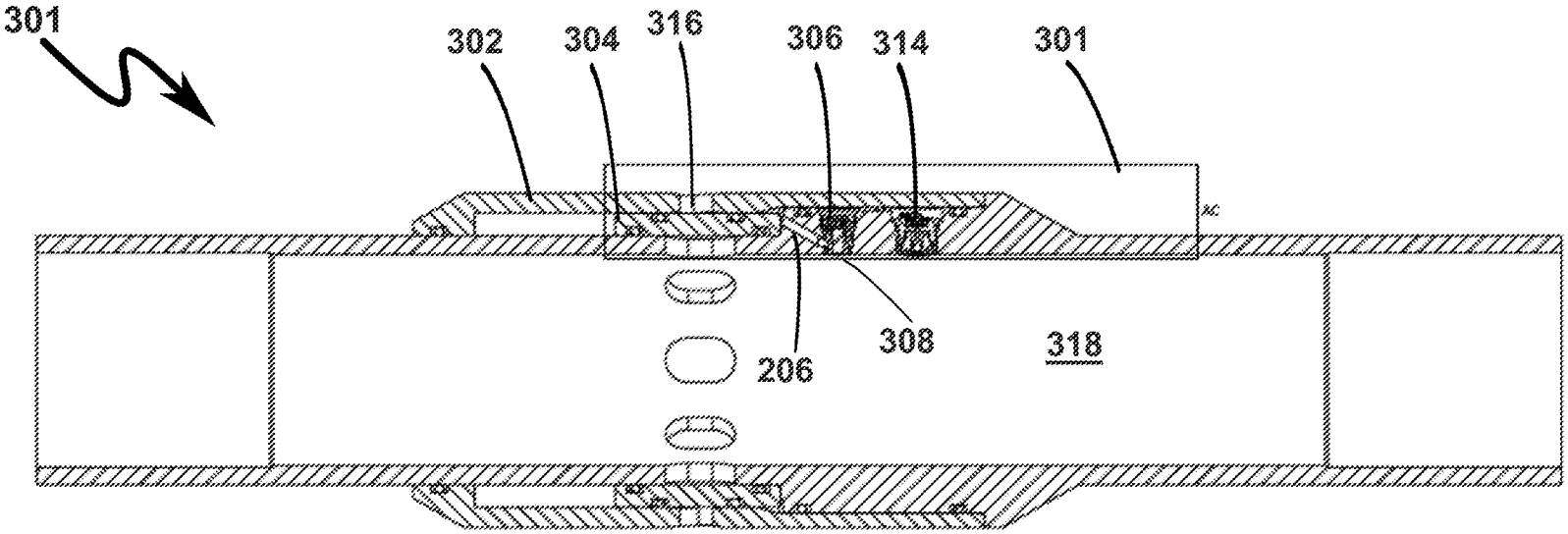
FIG. 3B illustrates a longitudinal cross-section of an electronic toe valve downhole tool.
Figure 3C:
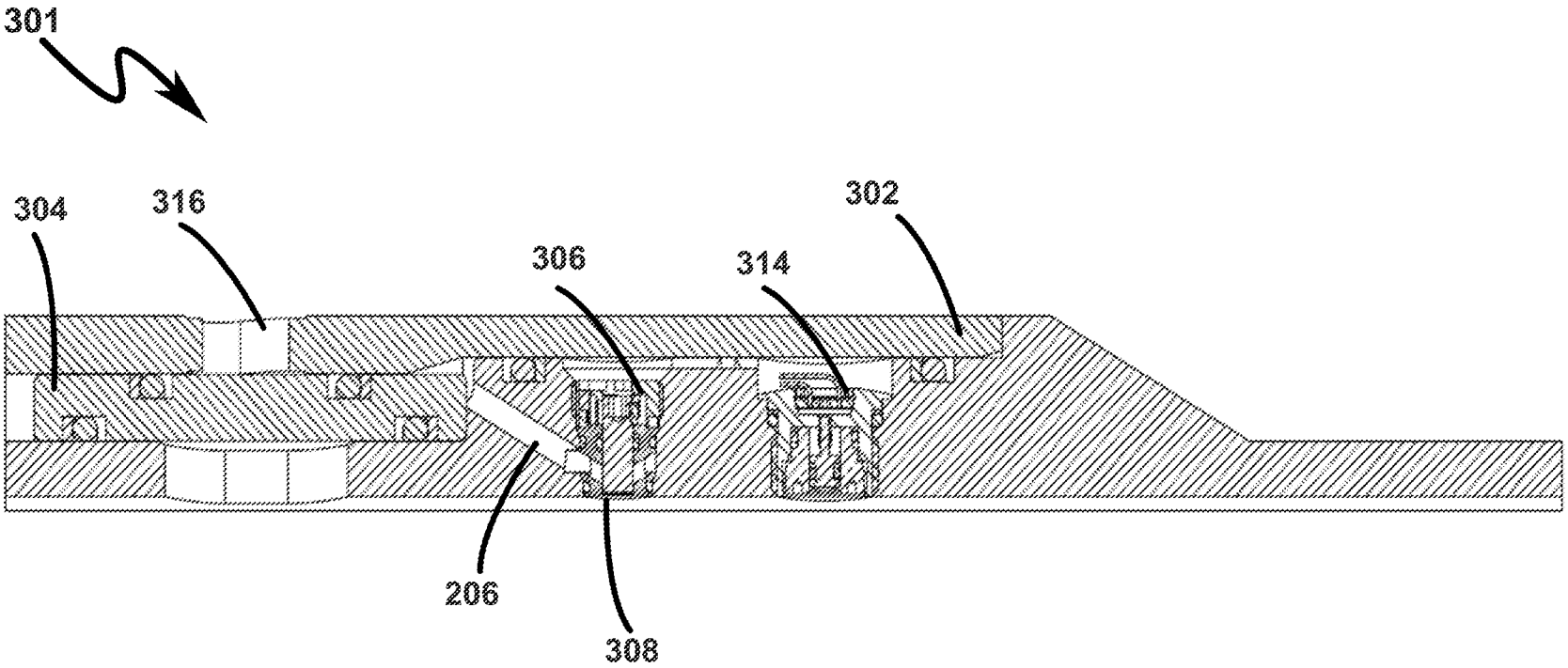
FIG. 3C shows a magnified portion of FIG. 3B.

FIG. 3 illustrates in cross section an exemplary embodiment of an electronic toe valve 300 downhole tool with two time delay apparatus, FIG. 3A shows a magnified view of the time delay apparatus, FIG. 3B shows a longitudinal cross-section of the electronic toe valve 300, and FIG. 3C shows a magnified view of the time delay apparatus of FIG. 3B. For simplicity, the symmetrical drawing will be explained in terms of only one of the hemispheres, it being understood that the other is identical, in this instance. The two exemplary time delay apparatus in this example are identical, albeit that two different types of embodiments could be used. In FIGS. 3B and 3C, an outer sleeve 302, such as a casing for example, surrounds an inner sleeve 304, such as the slidable sleeve of a slidable sleeve electronic toe valve. A detail 301 of the slidable sleeve electronic toe valve in FIG. 3B is shown enlarged in FIG. 3C. Having more than one time delay apparatus, as shown, provides redundancy to compensate for the risk of any particular timer failing to operate under conditions that may be adverse. Additionally, two timers could be used if two operations were to be activated by time delay apparatus. In the example illustrated, the electronic controller 310 includes a timer and is powered by batteries 312. A fusible link (not shown due to scale but is seen in FIG. 2) extends to restrain a spring in the split spool restraining device 306. A start "on" switch 314 initiates the timer countdown, and when the countdown is complete, the fusible link automatically commences burning. When the fusible link is sufficiently weakened, a center pin of the split spool device is released thereby causing the rupture disk 308 to burst. This in turn triggers a down hole tool operation, such as opening a valve port 316, which is located in the outer sleeve 302. When the rupture disk 308 is ruptured, a fluid from a bore 318 of the electronic toe valve 300 flows through the port 206 to the inner sleeve 304 to open the valve port 316.

Figure 4A:
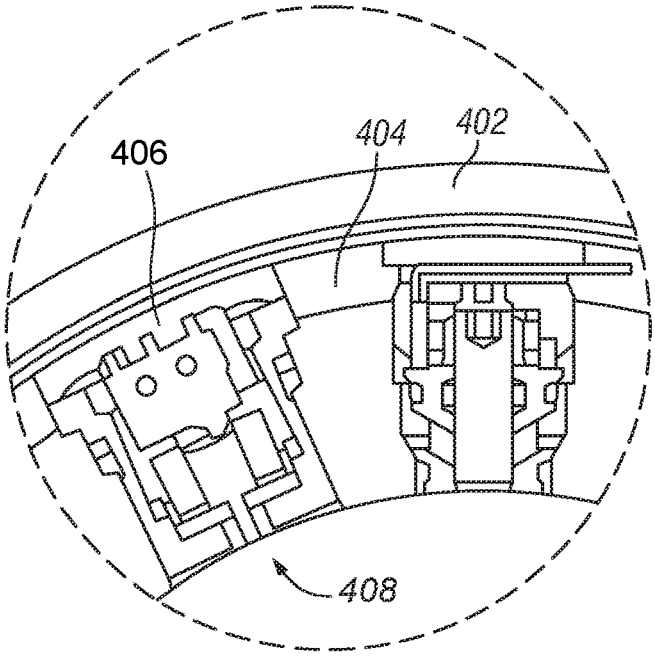
FIG. 4A illustrates a magnified portion of FIG. 4.
Figure 4:
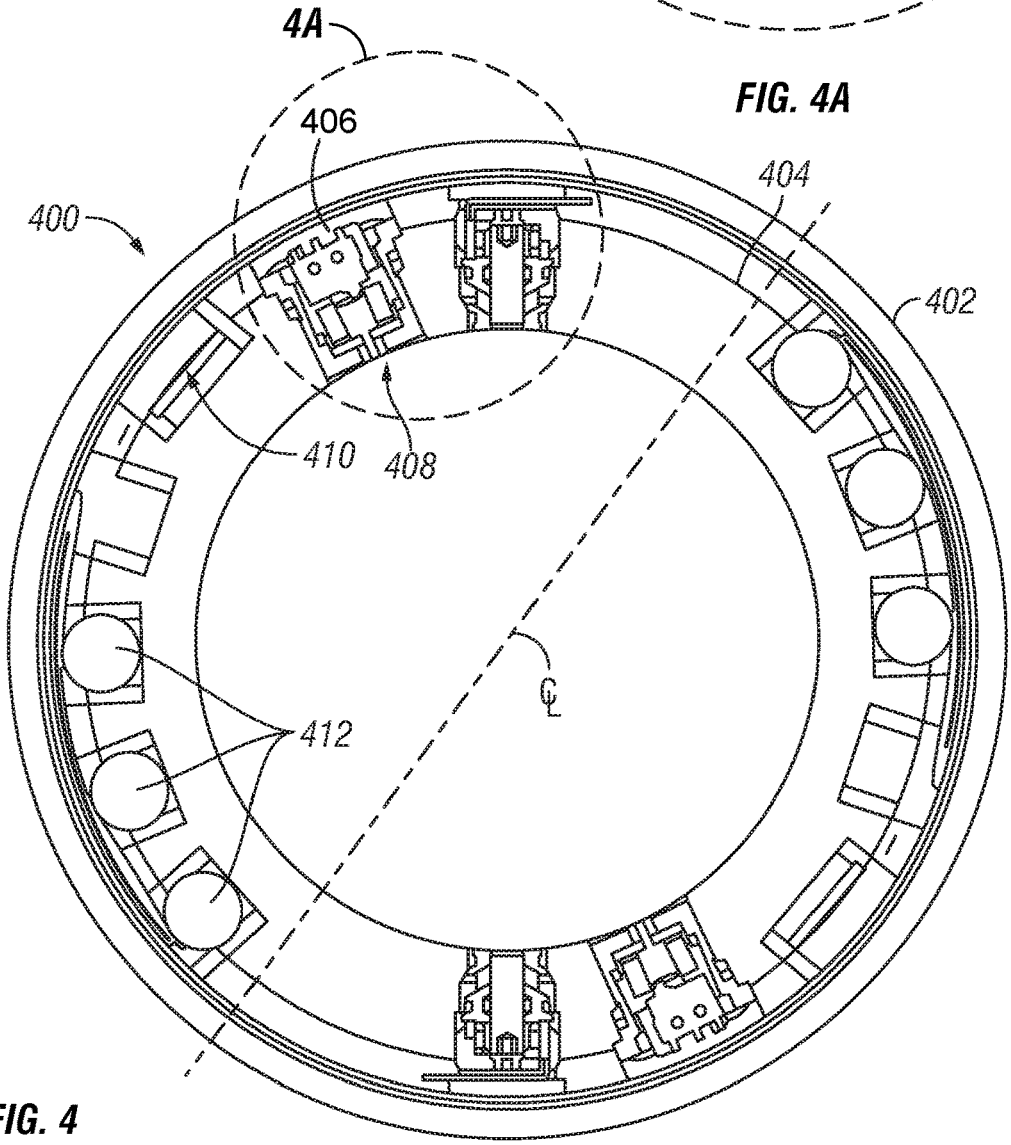
FIG. 4 illustrates in cross section an exemplary embodiment of an electronic toe valve with two alternative exemplary embodiments of the time delay apparatus.

FIG. 4 illustrates in cross section an alternative exemplary embodiment of an electronic toe valve 300 downhole tool with two time delay apparatus, and FIG. 4A shows a magnified view of the time delay apparatus. As before, for simplicity, the symmetrical drawing will be explained in terms of only one of the hemispheres, it being understood that the other is identical, in this instance. The two exemplary time delay apparatus in this example are identical, albeit that two different types of embodiments could be used. In the illustration, an outer sleeve 402, such as a casing for example, surrounds an inner sleeve 404, such as the slidable sleeve of a slidable sleeve electronic toe valve. In the example illustrated, the electronic controller 410 includes a timer and is powered by batteries 412. A fusible link (not shown due to scale but is seen in FIG. 2) extends to restrain a spring in the spilt spool restraining device 406. A pressure switch 406 initiates the timer countdown, and when the countdown is complete, the fusible link automatically commences burning. When the fusible link is sufficiently weakened, a center pin of the split spool device is released thereby causing the rupture disk 408 to burst. This in turn triggers a downhole tool operation, such as opening a valve port.

It should be noted that other structures can be substituted for the split spool exemplified above. For example, and without limitation, a mechanical/electronic structural device may be used, such as a pin held in place by a cross bar solenoid in an extended (restrained) position that moves into an unrestrained position after a time delay, and thereby causes the rupture disk to burst.

According to another exemplary embodiment, a time delay apparatus for activating a downhole tool in a wellbore casing may include a thin membrane coupled to an activator. The activator holds the membrane in place in a first (restrained) position and when the activator is triggered in response to a signal, for example an environmental signal, the activator moves to a second (unrestrained) position after a predetermined time delay thereby bursting the membrane. The activator may be structurally different but operate to provide the same or similar function as the split spool assembly, or a mechanical structure such as a pin held in place by a cross bar solenoid.

The environmental signal may be a pressure switch that functions when a pressure applied from the surface. Hydrostatic pressure, or wellbore pressure, is compared to a threshold pressure and the result of the comparison is used to enable, disable or reset the switch. The environmental signal may also be a flow rate sensor that functions when the flow rate of the well fluids or pumped down fluids is compared against a threshold flow rate and the result of the comparison used to enable, disable or reset the switch. Similarly, the environmental sensor may sense a chemical composition of the fluids, and based upon the sensed chemical parameter(s) the switch may be enabled, disabled or reset.

As detailed here above, an electronic circuit with a timer may act in response to an environmental input, such as pressure applied on a pressure switch. The action may be to start the timer. And when the timer expires, an actuation signal burns a fusible link, ruptures a disk and allows the valve to open. The electronic circuit may draw "ultralow power" until a trigger condition from the pressure switch is received. Ultralow power means less than about 1 milliwatt.] The environmental event may be the triggering condition that gates any switching condition in the circuit. The circuit may be running in a continuous ultralow power state while monitoring for a trigger condition. Due to power constraints downhole and the limited power supply from a battery, an ultralow power circuit enables longer survival of the electronic circuit.

The pressure variable from the pressure switch may reset the timer, count down the timer, or count up the timer. The mechanism of counting up, down or reset may be based on the applied pressure or pressure pulses. For example, when the applied pressure is less than a threshold pressure, the count may be set to go down. When the applied pressure is more than a threshold pressure, the count may be set to go down. A reset condition may be triggered by comparison of applied pressure and a threshold pressure, and a built in decision protocol. The reset feature may be used to stop and start the timer. Pressure pulses may also be used to activate different modes of the pressure switch.

The downhole tool may be a sliding valve, a toe valve or a spool valve. The time delay apparatus may be conveyed with the downhole tool in a well casing string. According to an exemplary embodiment the downhole tool is deployed with a wireline tool. According to another exemplary embodiment the downhole tool is pumped down into the well casing without a wireline tool.

According to yet another exemplary embodiment the time delay apparatus may be used to release a restrictive plug element from a downhole tool. According to yet another exemplary embodiment the downhole tool is conveyed with a tubing conveyed perforating (TCP). The downhole tool may function after a predetermined time delay, set in the time delay apparatus that includes electronic components, such as a timer and a controller, as explained above.

Figure 5:
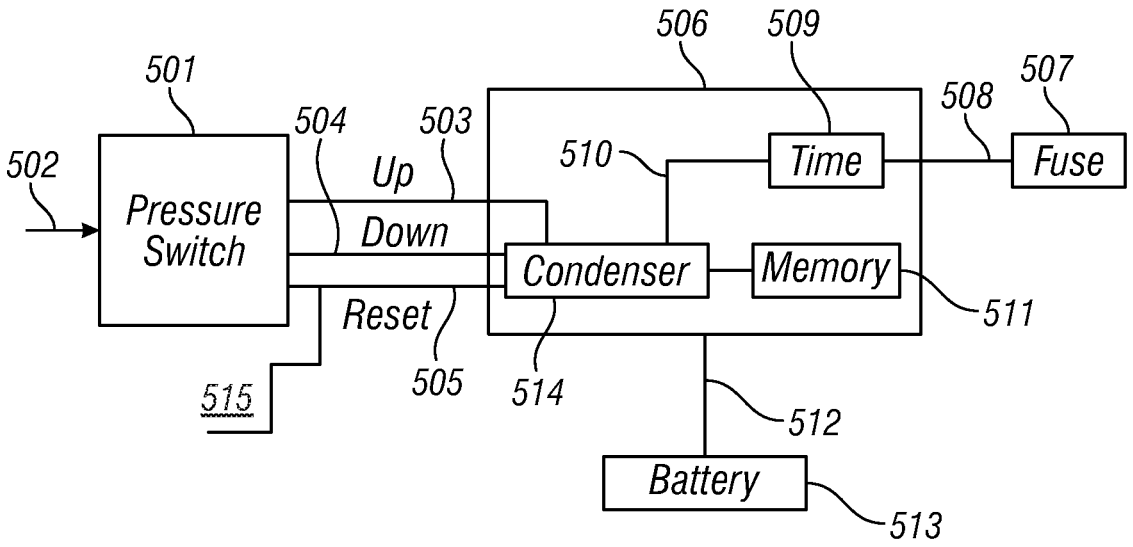
FIG. 5 illustrates a simplified block diagram of a portion of an exemplary embodiment of a time delay apparatus.

FIG. 5 generally illustrates components 500 of an exemplary time delay apparatus for use with a downhole tool according to an exemplary embodiment. A pressure switch 501 may receive a pressure input 502 and output electrical signals such as an up signal 503, a down signal 504, or a reset signal 505. The pressure switch 501 may also be programmed or provided with a threshold pressure (not shown). The down signal 504 may go high or a digital 1 when the applied pressure is less than a threshold pressure, the count may be set to go down. The up signal 503 may go high or a digital 1 when the applied pressure is greater than a threshold pressure, the count may be set to go up or increment by 1. A reset signal 505 may also be triggered by comparison of input pressure 502 and a threshold pressure. The reset feature would be most useful to stop and/or start the timer. Pressure pulses may also be used to activate different modes of the pressure switch. The input pressure 502 may be a series of pressure pulses and the pressure switch may be programmed to count the number of pressure pulses to generate a reset signal 505. The up signal 503, the down signal 504, and the reset signal 505 may be input to an electronic circuit 506. The electronic circuit 506 may also include a controller 514, a timer 509 and a memory block 511. The memory block 511 may be programmed with a timer value that the timer block may compare to generate an output signal 608 that is input to a fuse block 507. The fusible link burns and releases a spring when input signal 508 is asserted. The electronic circuit may have other "blocks" that are not shown in this exemplary circuit.

The controller 514 may hold the circuit 506 in a monitoring state until one of the input signals is triggered or go high (from a digital 0 to a digital 1). The controller may maintain a state machine (not shown) with states such as monitoring, idle, counting, and active. The state machine may keep track of the state of the circuit and keep the circuit in low power state when staying in certain states such as idle and monitoring. It is vital that the low power circuit draws a trickle amount of power from a battery source when not needed so that the longevity of the circuit is substantially long and survives the completion of the well and sometimes the production of the well. According to an exemplary embodiment, the electronic circuit 606 is in ultralow power mode in a monitoring state.

Figure 6:
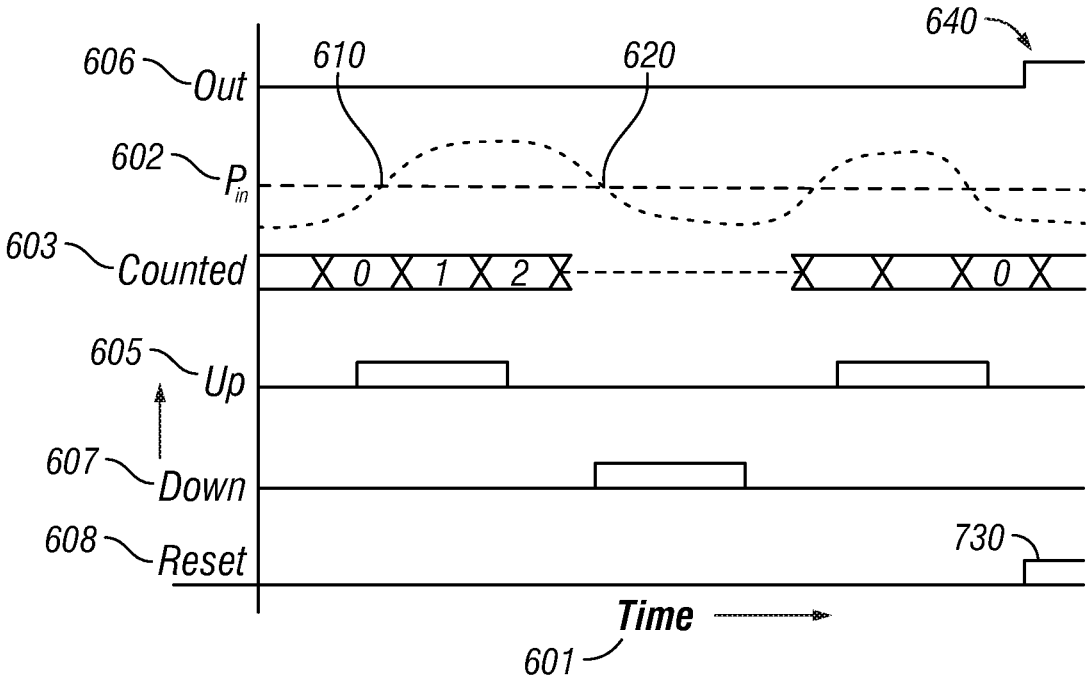
FIG. 6 illustrates an exemplary embodiment of a timing diagram of an electronic circuit in a time delay apparatus.

FIG. 6 illustrates an exemplary timing diagram 600 of the electronic circuit. The timing diagram may be plotted with time 601 on the x-axis. A threshold pressure 602 may be compared against input pressure 604 and signals 605, 607 and 608 may be generated. For example, the up signal 705 may be asserted when the pressure 604 exceeds threshold pressure 602 at a time 610. The timer counter 603 may increment every clock cycle (not shown) or at a fixed time period. In another example, the down signal 607 may be asserted when the pressure 604 falls below threshold pressure 602 at a time 620. The timer counter 603 may stay at the same level or decrement every clock cycle (not shown) or at a fixed time period. A reset signal 608 may also be generated by pulsing the input pressure and counting the number of pulses. For example, if the number of pulses is three or more the reset signal 608 may be asserted. The reset signal 608 may also be combined logically with an external reset signal such the timer counter 603 may be reset to 0. The output signal 606 of the timer block may be asserted when the timer counter is greater than or equal to a programmed timer value. The timer value may be programmed into a memory 511 shown in FIG. 5

According to an exemplary embodiment the downhole tool is a firing pin for an energetic device and the firing pin is released when a center pin travels from a restrained position to a functional position. In tubing conveyed perforating gun with a delay mechanism, a known delay interval between pressuring the tubing to a second pre-determined level and the actual firing of the perforating gun may be achieved by the predetermined time delay. In a select fire system, a delay means, to move a firing pin holder out of locking engagement with a firing pin to release the firing pin, may be achieved by the predetermined time interval. The firing pin may contact a percussion detonator/initiator that connects to a bidirectional booster. The bidirectional booster may accept a detonation input from the detonator. The detonating may be initiated in turn by the booster. The firing pin may be triggered when a rupture disk bursts after a pre-determined time delay, the firing pin may contact a percussion detonator and in turn initiate a detonator through a booster and a detonating cord.

In use, the time delay can be set for the particular circumstances. The timer can be configured for virtually any useful precision, and for any useful length of time. Thus, according to an exemplary method of using the time delay apparatus, the pre-determined time delay can be set in the range from about 1 hour to 48 hours. According to another exemplary method, the time delay ranges from about 2 days to 14 days. According to a most exemplary embodiment, the pre-determined time delay ranges from about 0.01 seconds to about 1 hour.

A limitation of prior art sleeve valves, is that the sleeve or power piston of the device that allows fluid to flow from the casing to a formation (through openings or ports in the apparatus wall) opens immediately after the actuation pressure is reached. This limits the test time at pressure, and in many situations precludes the operator from ever reaching the desired casing test pressure. An exemplary embodiment overcomes that limitation by providing an electronic time delay to the valve to allow a delay period of time to test the casing at the required pressure and for a required duration at this pressure before allowing fluid communication with the well bore and formation. This may accomplished by delaying a travel time of a piston covering the valve opening(s) to move to another position wherein the valve opening(s) are uncovered.

According to an exemplary embodiment two or more valves may be installed (run) as part of the same casing installation. This optional configuration of running two or more valves is made possible by the time delay that allows each of the valves to be opened at a different time by programming timers in each of the electronic circuits of the respective valves. The feature and option to run two or more valves in a single casing string increases the likelihood that the first stage of the well can be fracture stimulated without any well intervention. In general, the prior art as far as known does not allow more than a single valve to operate in the same well since no further actuation pressure can be applied or increased after the first valve is opened. According to an exemplary embodiment a multiplicity of valves may be used and each programmed with a respective time delay such as to open during desired stages of well operations. Thus, for example, one (or more) valves open at 5 minutes delay; and one (or more) opens at 20 minutes delay; and the like. In a further example, the apparatus may be configured so that an operator may open one or more valves (activating the sliding closure) after a five minute delay, fracturing the zone at the point of these open valves, while having other valves still closed, and then continue to open these valves at time delays and continue to fracture the zone.

In yet another exemplary embodiment the downhole tool is a spool valve. The spool valve opens up a port when the center pins travels from the restrained position to a functional position in a time delay apparatus.

An exemplary method of using the time delay apparatus in a downhole may include at least some of the following steps, depending upon factors that include the specific embodiment of the time delay apparatus used, the type of downhole tool, and the circumstances of the operation:

(1) installing the downhole tool in a wellbore along with the time delay apparatus mounted therein;

(2) activating a trigger device such as, for example, an environmental sensor. This may entail applying pressure on a pressure activated device;

(3) starting a timer in the electronic circuit, previously configured with a desired time delay period, based on the activating step;

(4) automatically initiating burning a fusible link after expiry of the time delay period;

(5) releasing tension from the spring element (or equivalent structural feature used) as a result of at least partially burning the fusible link;

(6) moving the center pin (or equivalent structural feature used) to a functional position from a previous restrained position; and (7) activating the downhole tool when the functional position is attained. For example, rupturing a pressure activated device and enabling fluid communication through a port in an electronic toe valve, or triggering a perforating gun, and the like.

Of course, not every method will include each of these steps, and some methods may include additional steps. Nonetheless, the foregoing steps exemplify and guide those of skill in the art as to the practice of the time delay technology presented herein.

While examples of embodiments of the technology have been presented and described in text and some examples also by way of illustration, it will be appreciated that various changes and modifications may be made in the described technology without departing from the scope of the inventions, which are set forth in and only limited by the scope of the appended patent claims, as properly interpreted and construed.

What is claimed:

1. A time delay apparatus for use with a downhole tool in a wellbore casing, the apparatus comprising:

an electronic circuit having a timer configured to be programmed with a time interval;

a trigger configured to activate the timer to commence a countdown of a programmed time interval;

a downhole tool activator; and a fusible link configured to connect between the downhole tool activator and the electronic circuit, the fusible link degrading during a predetermined time period, wherein the electronic circuit, the trigger, the downhole tool activator, and the fusible link are located on the downhole tool, and wherein, upon activation of the timer in the electronic circuit, and expiration of the time interval of the timer, the fusible link commences degrading such that after the predetermined time period, the downhole tool activator is automatically triggered.

2. The time delay apparatus of claim 1, wherein the trigger comprises an environmentally activated trigger.

3. The time delay apparatus of claim 1, wherein the trigger comprises an electrically activated trigger.

4. The time delay apparatus of claim 1, wherein the fusible link comprises a link of an electrically conductive material that degrades as current passes through it.

5. The time delay apparatus of claim 1, wherein the downhole tool activator comprises a split spool valve having a center pin held in place in a restrained position with a spool, a spring element surrounding the spool.

6. The time delay apparatus of claim 1, further comprising a timer block, the timer block activated upon expiration of the programmed timer interval, the timer block generating a signal to degrade the fusible link.

7. The time delay apparatus of claim 1 wherein the downhole tool is a sliding sleeve valve, and the downhole tool activator allows, after being automatically triggered, a fluid from a bore of the sliding sleeve valve to move an inner sleeve to open a port formed in an outer sleeve.

8. The time delay apparatus of claim 1, wherein the trigger includes a pressure sensor responsive to pressure pulses.

9. The time delay apparatus of claim 8, wherein the electronic circuit is configured to be reset by pressure pulses transmitted to the pressure sensor.

10. The time delay apparatus of claim 1, wherein the downhole tool activator comprises a rupture disk that is configured to rupture to allow a fluid from a bore of the downhole tool to move through the downhole tool activator.

11. The time delay apparatus of claim 1 wherein the downhole tool activator is configured to release a firing pin to activate a perforating gun.

12. The time delay apparatus of claim 1 wherein the downhole tool activator is configured to open a port in a spool valve of the downhole tool.

13. The time delay apparatus of claim 1, wherein the apparatus is configured to receive batteries as a power source.

14. The time delay apparatus of claim 1, wherein the trigger is pressure-activated, and the timer is configured to start or reset when pressure pulses are received by the trigger.

15. A time delay apparatus for use with a downhole tool in a wellbore casing, the apparatus comprising:

an electronic circuit having a timer configured to be programmed with a time interval;

a trigger configured to activate the timer to commence a countdown of a programmed time interval; and a downhole tool activator in communication with the electronic circuit, the downhole tool activator activated by the electronic circuit after expiration of a programmed time interval of the timer, wherein the downhole tool activator is configured to operatively manipulate the downhole tool from a first condition, in which no fluid from a bore of the downhole tool passes the downhole tool activator, to a second condition, in which the fluid from the bore of the downhole tool passes through the downhole tool activator, and wherein the electronic circuit, the trigger, and the downhole tool activator are located on the downhole tool.

16. The time delay apparatus of claim 15, wherein the trigger comprises an environmentally activated trigger.

17. The time delay apparatus of claim 15, wherein the trigger comprises an electrically activated trigger.

18. The time delay apparatus of claim 15, wherein the downhole tool activator comprises a split spool valve having a center pin held in place in a restrained position with a spool, a spring element surrounding the spool.

19. The time delay apparatus of claim 15, further comprising a timer block, the timer block configured to generate a signal to the downhole tool activator.

20. The time delay apparatus of claim 15, wherein the downhole tool activator comprises a rupture disk.

21. The time delay apparatus of claim 15, wherein the downhole tool activator is configured to activate a perforating gun.

22. The time delay apparatus of claim 15, wherein the apparatus is configured to receive batteries as a power source.

23. The time delay apparatus of claim 15, wherein the downhole tool is a sliding sleeve valve, and the downhole tool activator allows, after being automatically triggered, a fluid from a bore of the sliding sleeve valve to move an inner sleeve to open a port formed in an outer sleeve.

24. The time delay apparatus of claim 15, wherein the trigger is configured to respond to pressure pulses to start or reset the timer.

25. The time delay apparatus of claim 15, wherein the downhole tool activator is configured to open a port in the downhole tool.

* * * * *